US011076637B2

(12) United States Patent
Barenboym

(10) Patent No.: US 11,076,637 B2
(45) Date of Patent: Aug. 3, 2021

(54) COMPACT PIPE FOR SMOKING CANNABIS

(71) Applicant: Michael Barenboym, Boston, MA (US)

(72) Inventor: Michael Barenboym, Boston, MA (US)

(73) Assignee: Weedgets Inc., Boston, MA (US)

( * ) Notice: Subject to any disclaimer, the term of this patent is extended or adjusted under 35 U.S.C. 154(b) by 267 days.

(21) Appl. No.: 16/533,223

(22) Filed: Aug. 6, 2019

(65) Prior Publication Data

US 2021/0037882 A1 Feb. 11, 2021

(51) Int. Cl.

| | |
|---|---|
| ***A24F 1/16*** | (2006.01) |
| ***A24D 3/04*** | (2006.01) |
| ***A24F 1/32*** | (2006.01) |

(52) U.S. Cl.

CPC ..... *A24F 1/16* (2013.01); *A24D 3/04* (2013.01); *A24F 1/32* (2013.01)

(58) Field of Classification Search

CPC ..... A24F 1/16; A24F 1/28; A24F 1/32
See application file for complete search history.

(56) References Cited

U.S. PATENT DOCUMENTS

| | | | | |
|---|---|---|---|---|
| 879,796 | A | 2/1908 | Plane | |
| 1,261,038 | A | 4/1918 | Labreche | |
| 1,413,580 | A * | 4/1922 | Gruen | A24F 1/16 131/217 |
| 2,035,398 | A | 3/1934 | Muller | |
| 2,033,867 | A | 3/1936 | Segal | |
| 2,190,312 | A | 2/1940 | Cullen | |
| 2,273,858 | A | 2/1942 | Gesek | |
| 2,354,712 | A | 8/1944 | Stieger | |
| 2,385,651 | A | 9/1945 | Ricketts | |
| 2,462,446 | A | 2/1949 | Wellborn | |
| 2,502,545 | A | 4/1950 | Wellborn | |
| 2,815,030 | A | 12/1957 | Wenger | |
| 2,827,903 | A | 3/1958 | Niederman | |
| 3,174,487 | A | 3/1965 | Missler | |
| 3,490,461 | A | 1/1970 | Osmalov | |
| 4,014,353 | A | 3/1977 | Kahler | |
| 4,029,109 | A | 6/1977 | Kahler | |
| 4,203,456 | A | 5/1980 | Miller | |
| 5,896,860 | A | 4/1999 | Lockett | |
| 2018/0035709 | A1 | 2/2018 | Lara | |

FOREIGN PATENT DOCUMENTS

| | | |
|---|---|---|
| CH | 628507 | 3/1982 |
| FR | 446338 | 12/1912 |
| SU | 6818 | 10/1928 |

* cited by examiner

*Primary Examiner* — Eric Yaary
(74) *Attorney, Agent, or Firm* — Boris Leschinsky

(57) ABSTRACT

A compact pipe for smoking cannabis features an elongated smoke pathway prior to entering the mouthpiece so as to cause smoke cooling and purification by removal of smoking debris along the pathway. An elongated serpentine groove is formed on the exterior of an elastic stem insert configured for insertion into a rigid outer shell during the pipe assembly. Elastic stem insert also serves to brush off smoke stains and deposits of smoke debris from the inside of the outer shell, making cleaning of the pipe easy and convenient. A smoke chamber is formed below the cannabis container to cause even distribution of air and smoke flow throughout the volume of cannabis to eliminate the need to frequently light up the pipe during use.

20 Claims, 11 Drawing Sheets

COMPACT PIPE FOR SMOKING CANNABIS

BACKGROUND

Without limiting the scope of the invention, its background is described in connection with smoking pipes. More particularly, the invention describes a smoking pipe adapted for smoking cannabis.

The use of pipes for the consumption of smoked organic products is well known in the art. There are numerous types of pipes that have been used over the years to smoke tobacco.

With many states now allowing the medical use of cannabis, and at least several states at the present time allowing the recreational use of cannabis by anyone of legal age, there is a renewed interest in pipes that are designed specifically for smoking cannabis. Of course, any of these smoking pipes can also be used with tobacco or other smoking substances.

There are numerous types of pipes used to smoke cannabis and other organic products. These generally include water pipes, bongs, hookahs, straight pipes, steamroller pipes, briar pipes and numerous specialty pipes. Many pipes for smoking cannabis are small and made of glass, since glass avoids any interaction of the heated smoke with wood or other material. Glass pipes however are fragile and have the tendency to get hot. There is a need for a smoking pipe that does not contain brittle materials such as glass.

One common element of various cannabis pipes is a narrow stem which may be a long flexible or rigid tube. The smoking material is conventionally placed in the receptacle and lit with a heat source while air is drawn through the bowl and across the long stem towards the user. However, the typical glass pipe is fragile and difficult to clean, and it usually has only one fixed bowl of various sizes and shapes.

There are two benefits of providing a long tube between the smoking material and the mouthpiece: to cool the smoke along the way so as to prevent the risk of inhaling hot smoke, which may cause lung injuries; and to remove various smoking debris and inclusions in the smoke such as unburnt pieces of plant, droplets of tar or oil, etc. While these long devices may serve these purposes well, their size makes it problematic for travel or transport purposes. There is a need for a compact cannabis pipe having these same benefits in a smaller size package.

Another issue with using conventional pipes and devices for smoking cannabis is cleaning of these devices—after a few uses, smoking deposits cover the insides of the device making it necessary to clean. Removing smoking deposits from small crevices and passages inside many of conventional smoking pipes is difficult and tedious. Frequently, these smoking devices contain a large number of interconnected parts which are difficult to disassemble, remove the stains and debris, and then put together again. The need exists for a cannabis smoking pipe that is easy to clean.

A further limitation of current pipes for smoking cannabis and other smoking materials is that they require multiple starter lighting throughout use. If the user does not frequently draw smoke through the pipe, the burning of the smoking material often goes out. In that case, resuming smoking requires the user to light the pipe again. This may occur several times, whereby repeated efforts to light the pipe making smoking to be less enjoyable. The need exists to have a smoking pipe that remains lit after the start of a smoking session.

SUMMARY

Accordingly, it is an object of the present invention to overcome these and other drawbacks of the prior art by providing a novel compact pipe for smoking cannabis or other organic smoking material containing an elongated smoke pathway so as to cool and purify smoke prior to entering the mouthpiece of the pipe.

It is another object of the present invention to provide a compact pipe for smoking cannabis, whereby the pipe has just a few parts that are easy to take apart and clean.

It is a further object of the present invention to provide a pipe for smoking cannabis with a visual indicator of the need to clean thereof.

It is yet a further object of the present invention to provide a self-contained pipe for smoking cannabis capable of storing cannabis prior to smoking in an air-tight manner so as to minimize propagation of cannabis aroma outside the pipe.

It is yet a further object of the present invention to provide a smoking pipe that remains lit after initial ignition of the smoking material—even when the user does not frequently draw air to create smoke flow through the pipe.

The compact pipe for cannabis smoking contains an elongated smoke pathway arranged in a convoluted serpentine shape. The smoke pathway is formed as a serpentine groove made along an external surface of an elongated elastic stem insert. The pathway for smoke is formed when the elastic stem insert is placed inside a rigid outer shell with a smooth internal surface having an inner diameter slightly smaller than the outer diameter of the external portion of the elastic stem insert—so as to provide for a secure friction fit between these two components when the stem insert is compressed inside the outer shell. The elastic stem insert is made together with a pipe bowl protruding from one end thereof and having a well for receiving smoking material therein, such as a single- or repeated-use container filled with cannabis. The container may be made of metal with a built-in screen so as to retain ash and other non-burnt particles inside thereof during and after completion of a smoking session. Drawing air through a mouthpiece causes the smoke from burning cannabis to travel from the pipe bowl along an elongated smoke pathway between the elastic stem insert and the rigid outer shell where it cools off. The convoluted shape of the pathway causes droplets and other rigid and liquid smoke debris and inclusions to deposit on the walls of the pathway which prevents inhaling thereof by the user.

The pipe for smoking cannabis further features a transparent observation window formed along the rigid outer shell allowing visual monitoring of the extent of deposits of smoke impurities along the serpentine pathway of the pipe. Once the pipe needs cleaning, the elastic stem insert is pulled out of the rigid outer shell, causing the edge of the serpentine pathway to scrape the inner wall of the rigid outer shell and remove the smoking deposits and stains therefrom. Simple washing with soap may follow to remove deposits from the serpentine pathway, such that the pipe may be easily reassembled afterwards to prepare for further use.

BRIEF DESCRIPTION OF THE DRAWINGS

Subject matter is particularly pointed out and distinctly claimed in the concluding portion of the specification. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION OF PREFERRED EMBODIMENTS OF THE INVENTION

Figure 1:
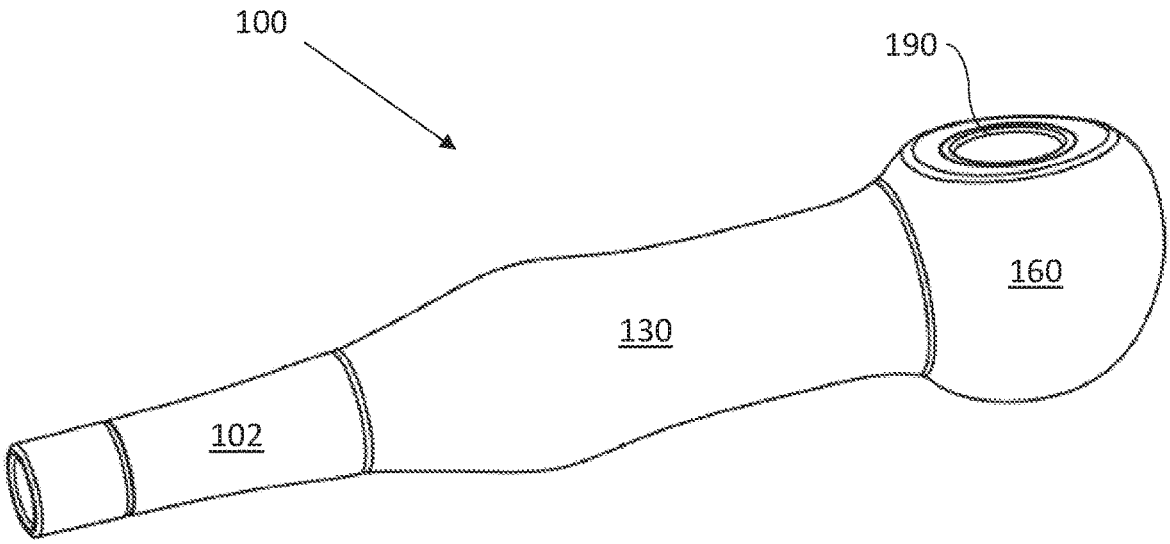
FIG. 1 is a perspective view of the pipe assembly of the present invention.
Figure 2:
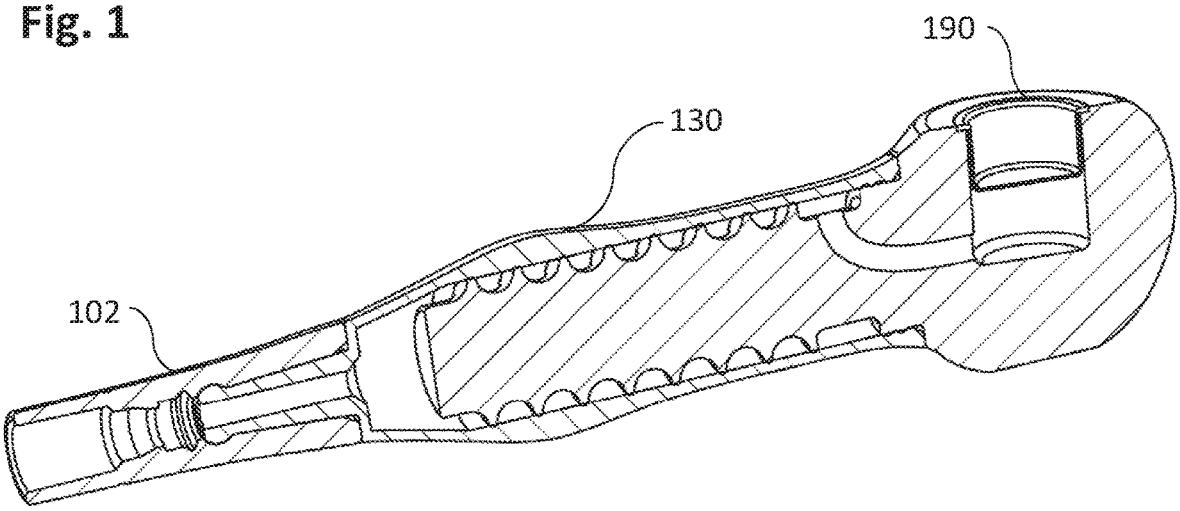
FIG. 2 is a perspective view showing a longitudinal cross-section of the same as in FIG. 1.
Figure 3:
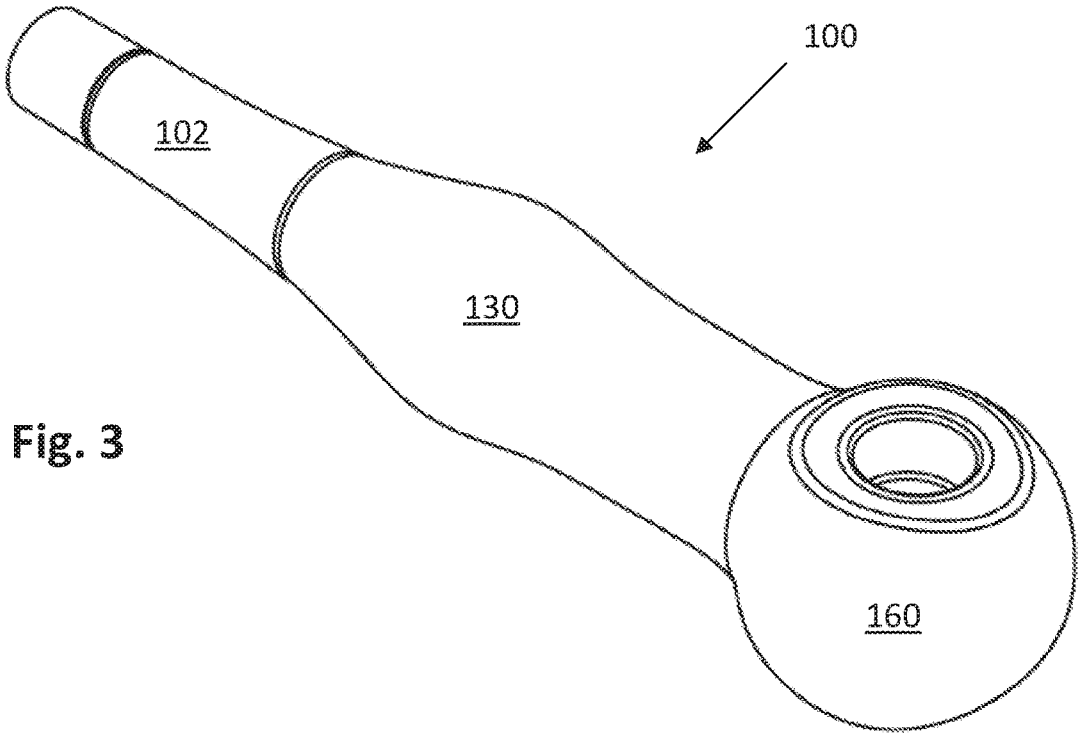
FIG. 3 is another perspective view of the present invention.
Figure 4:
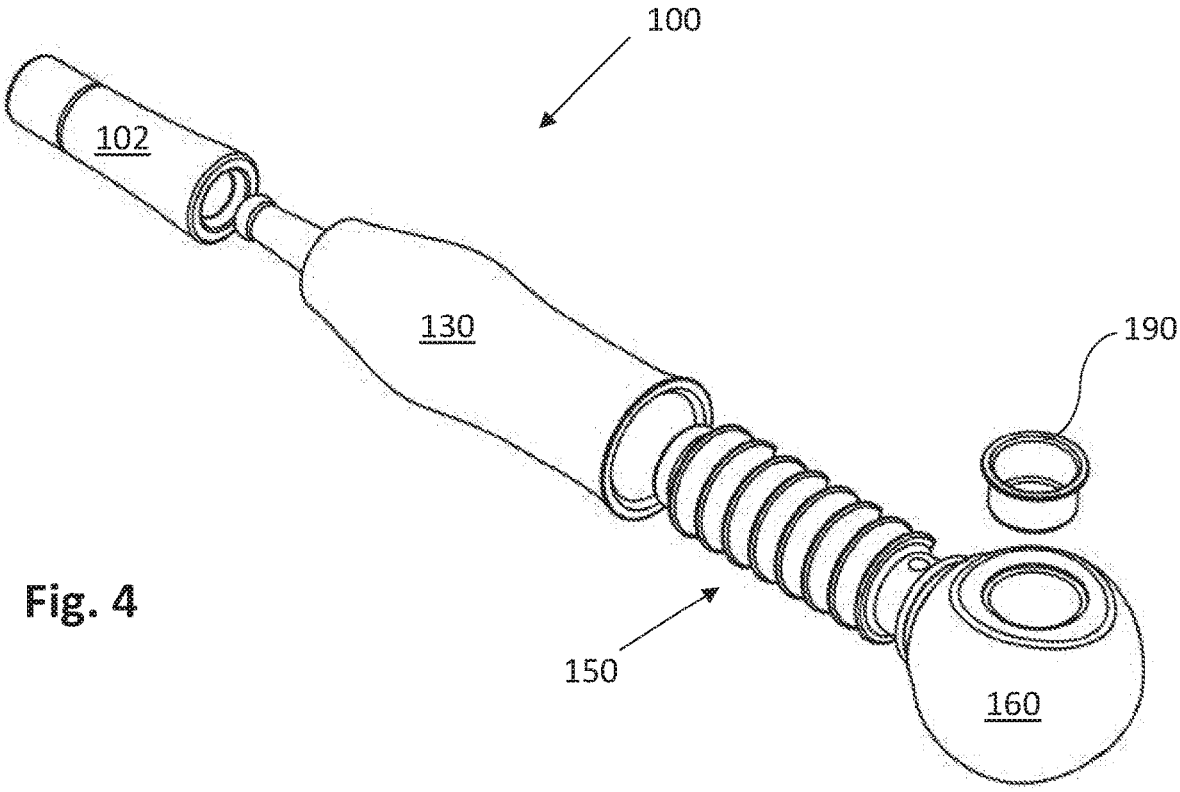
FIG. 4 is an exploded perspective view of the pipe of the present invention showing all components thereof.
Figure 5:
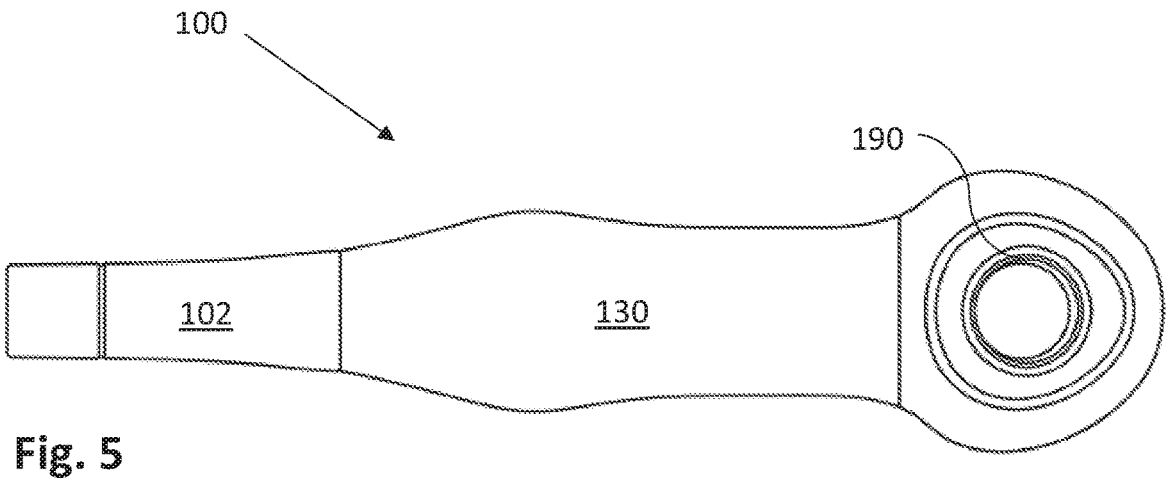
FIG. 5 is a top view of the smoking pipe of the invention.
Figure 6:
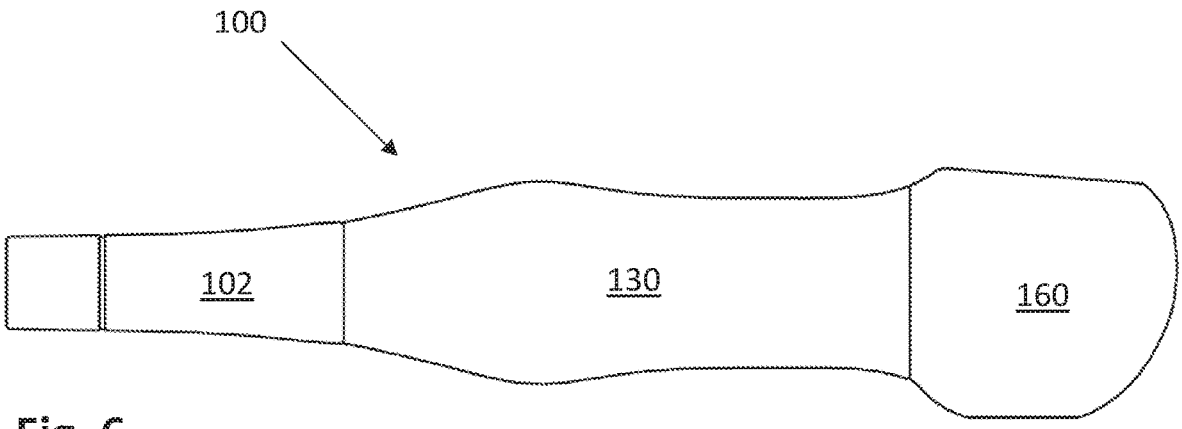
FIG. 6 is a side view of the same.
Figure 7:
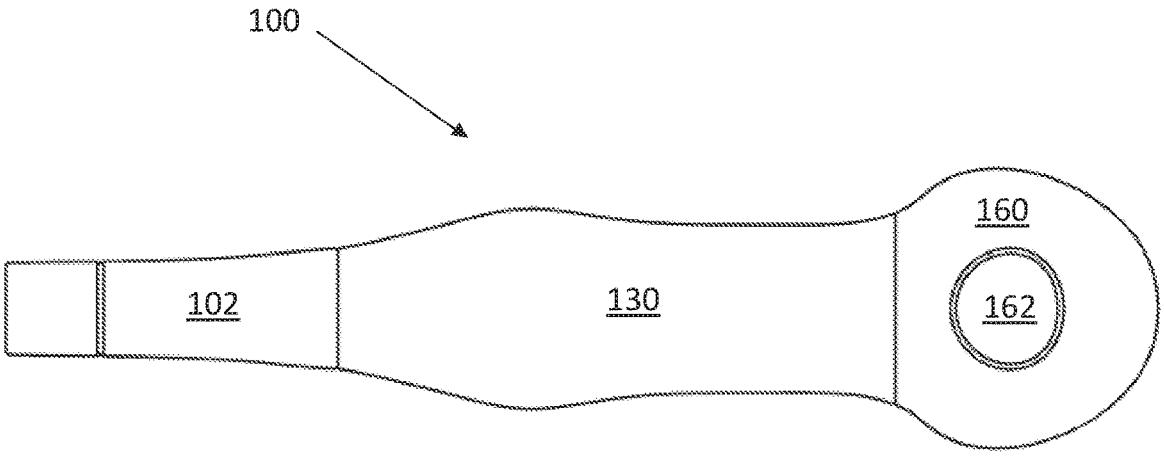
FIG. 7 is a bottom view of the same.

The following description sets forth various examples along with specific details to provide a thorough understanding of claimed subject matter. It will be understood by those skilled in the art, however, that claimed subject matter may be practiced without one or more of the specific details disclosed herein. Further, in some circumstances, well-known methods, procedures, systems, components and/or circuits have not been described in detail in order to avoid unnecessarily obscuring claimed subject matter. In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

FIGS. 1 through 7 show various views of the smoking pipe assembly of the present invention. The pipe 100 for smoking cannabis generally consists of four major components: a mouthpiece 102, a rigid outer shell 130, an elastic stem insert 150 made together with the bowl 160 as a single unit, and a cannabis container 190 configured to fit in the opening of the bowl well 164.

The mouthpiece 102 may be generally made from an elastic material and may optionally contain a screen or a filter within thereof. In embodiments, the mouthpiece 102 may be made using the principles and concepts described in my co-pending U.S. patent application Ser. No. 16/445,189 entitled "UNIVERSAL ELASTIC IMPLEMENT FOR SMOKING TOBACCO, CANNABIS AND E-CIGARETTES WITH A BUILT-IN SCREEN", filed 18 Jun. 2019 and incorporated herein by reference in its entirety. In particular, it may be sized to allow for an elastic engagement with a corresponding feature of the outer shell 130 described below in greater detail—so as to allow removal and replacement if needed.

The cannabis container 190 may be made from a metal such as steel or aluminum, which may be drawn to form a cavity containing cannabis or another smoking material. Desired amount of cannabis may be placed inside and retained therein at the beginning or prior to the smoking session. Typically, such container may have a bottom containing small openings in the form of a screen, such openings or pores may be sized to allow unobstructed passage of smoke and air therethrough but prevent or at least restrict a passage of larger solid particles or fluid droplets. When the cannabis is lit, the container 190 may be configured to retain the organic smoking material inside while it is slowly burning, such that an air flow initiated by the inhaling effort of the user may carry the smoke towards the user's lungs. Once the smoking session is finished, the container 190 may be discarded and replaced with a new one in order to avoid the need to clean thereof from the ash and organic smoking debris remaining therein. The bottom screen in that case serves as a first line filter to prevent undesirable particles and droplets of tar from moving towards the user.

Figure 8:
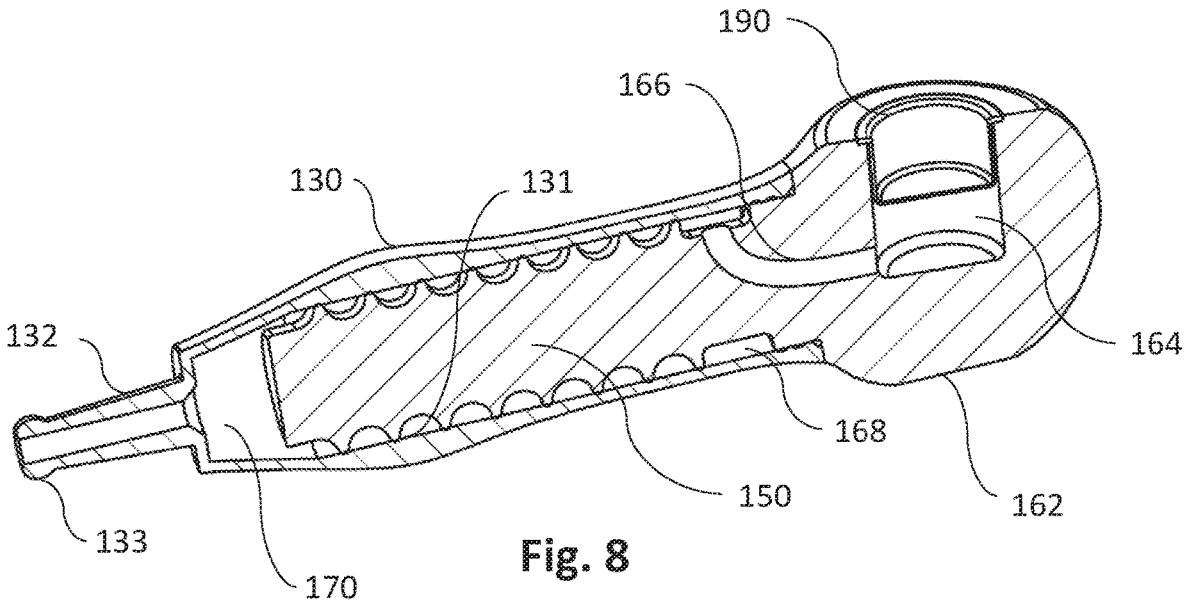
FIG. 8 is a cross-sectional perspective view of the subassembly of the smoking pipe of the present invention with mouthpiece being removed.
Figure 9:
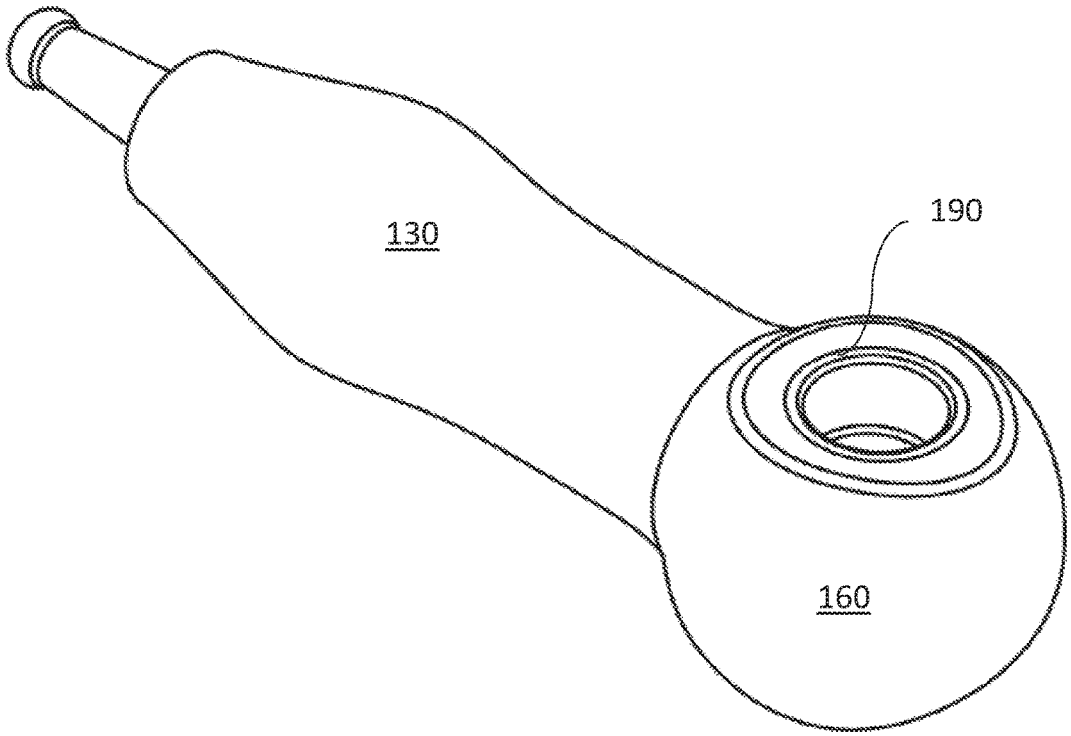
FIG. 9 is a perspective view of the same.

Other main components of the pipe of the invention are shown as a subassembly in FIGS. 8 and 9 where the mouthpiece 102 is removed. The rigid outer shell 130 may be shaped externally as a generally round pipe holder and may contain an extension 132 sized and designed to be engaged with an elastic mouthpiece 102 using a bulbous tip 133. A generally cylindrical and elongated inner well with an interior wall 131 and an open end may be made inside the outer shell 130—see FIG. 4.

The outer shell 130 may be made using a thermo-conductive material such as a metal, aluminum for example, which may be optionally anodized using various colors to achieve an esthetically pleasing appearance. This approach also allows for easy customization of the pipe of the invention by using different colors or color patterns on the exterior surface of the outer shell 130. Use of a thermo-conductive material for the outer shell 130 allows quick dissipating of the heat coming from the hot smoke traveling along the serpentine pathway inside the outer shell 130. In embodiments, the length of the outer shell 130 excluding the extension 132 may be from about 1.5 inches to about 4 inches so as to make the entire pipe to have a compact size and small weight—therefore facilitating its easy transport.

Figure 10:
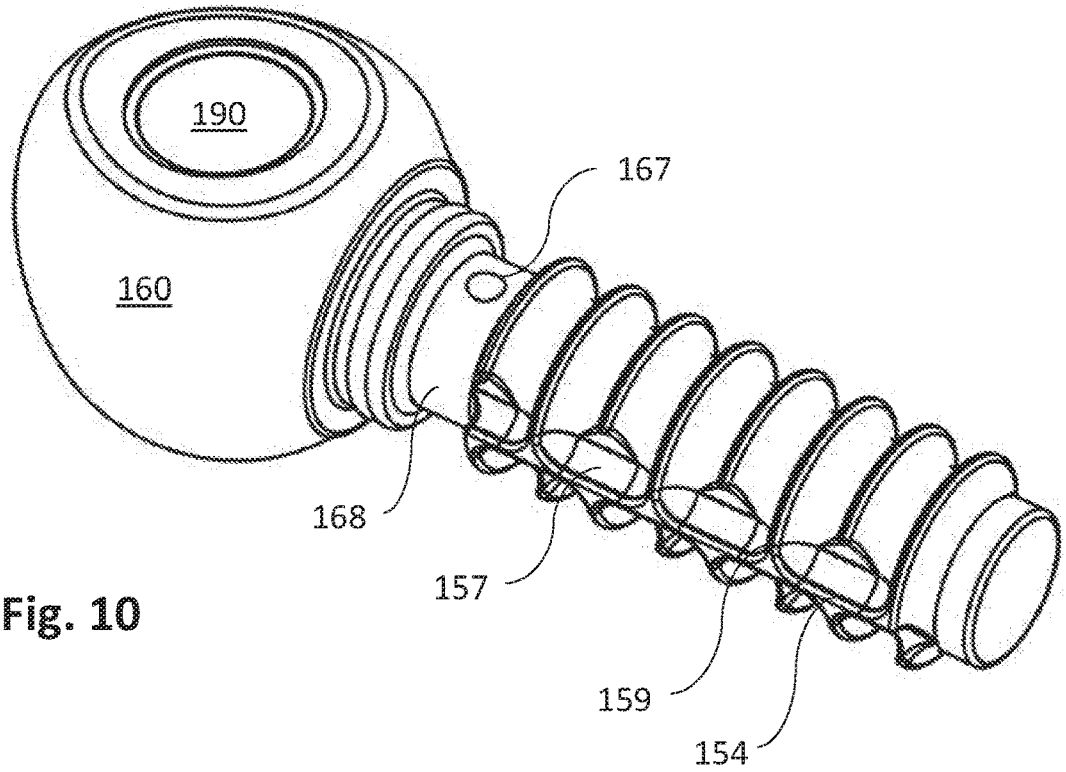
FIG. 10 is a perspective view of the elastic stem insert.
Figure 11:
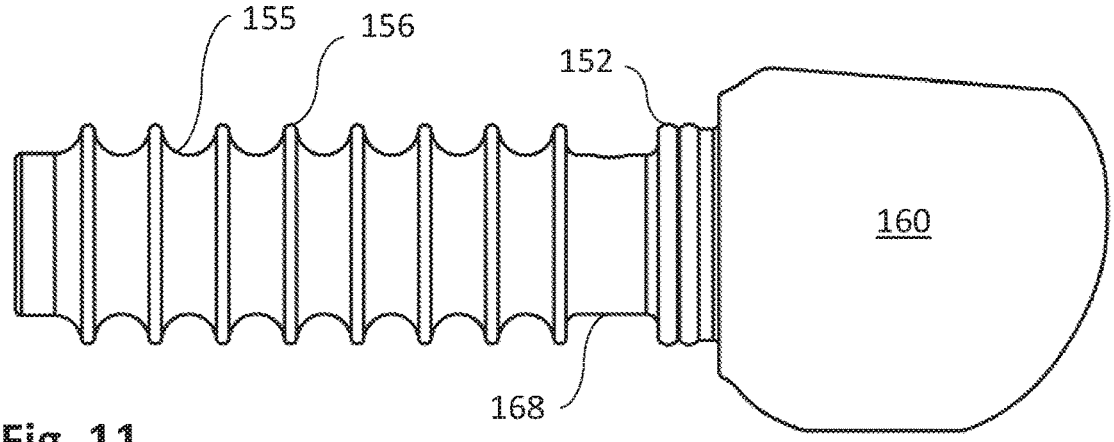
FIG. 11 is a side view of the same.
Figure 12:
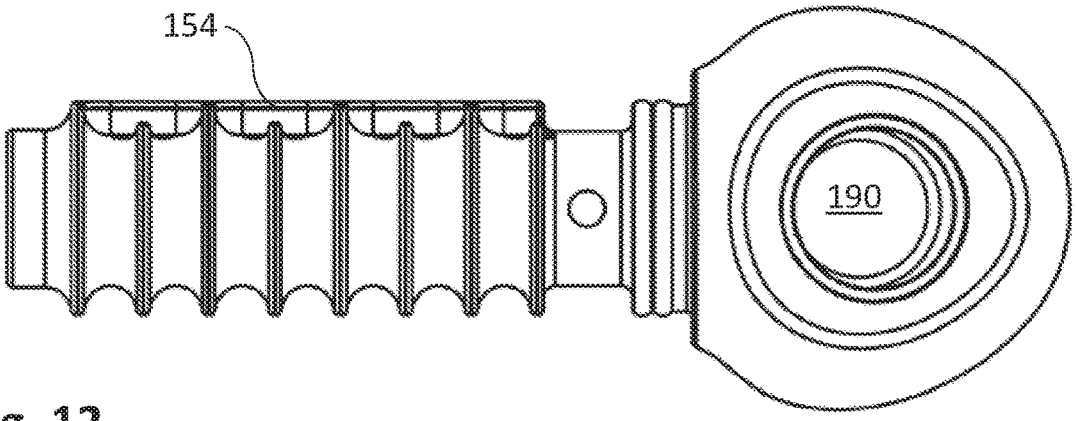
FIG. 12 is a top view of the same.

The elastic elongated stem insert 150 may be configured for insertion into the open end of the outer shell 130. It may be made together with the pipe bowl 160 as a single unit and from the same elastic material, as shown in greater detail in the views seen in FIGS. 10, 11, and 12. The pipe bowl 160 protruding from one end of the stem insert 150 may be made in a generally ball-like shape with an optional flat portion 162 designed to prevent the pipe from rolling around when placed onto a hard surface such as a desk or a table.

The pipe bowl 160 may have a bowl well 164 sized to serve as a receptacle for the smoking material, such as the cannabis container 190 that may be positioned with a friction fit inside thereof—see FIG. 8. The bottom of the bowl well 164 may contain a passage 166 operably connecting the bowl well 164 through the opening 167 to the exterior of the circular smoke entry 168 in the elastic stem insert 150. The size of the pipe bowl may be about 1 to 1.5 inches in diameter as the invention is not limited in this regard.

While conventionally the bowl well 164 may be filled entirely with the smoking material or occupied with the cannabis container 190 throughout its internal volume, it may cause frequent interruptions of the burning process of cannabis unless the user frequently draws air through the pipe to keep the burning process going. This is because the opening of the passage 166 leading the smoke towards the user is generally small in comparison to the size of the bowl well 164. As such, all air flowing through the volume of the smoking material such as cannabis has to find a narrow path through the compacted smoking material and into the passage 166. That limited air flow may be able to maintain continuous burning only at some portions of the smoking material volume, while other portions of that volume are not exposed to periodic draws of air and therefore are at increased risk of the burning process going out.

The present invention addresses this problem to arranging the flow of air to be evenly distributed throughout the entire volume of the smoking material so as to maintain the slow burning process for a longer time, whereby reducing or even eliminating the need to light the pipe multiple times during a single smoking session. This is accomplished by providing a smoke chamber between the cannabis container 190 and the passage 166. In its simplest form, the smoke chamber is formed under the cannabis container 190 by providing the bowl well 164 to have greater depth than the size of the cannabis container 190—see FIG. 8. In embodiments, the height of the space in the bowl well below the cannabis container forming the smoke chamber may be at least the same as the size of the passage 166 or greater than this size. In this case, drawing smoke through the passage 166 causes vacuum to be formed in the smoking chamber below the cannabis container 190. Since the cannabis container 190 may feature a screen extending throughout its bottom, the vacuum from the smoking chamber will be evenly distributed throughout the screen on the bottom of the smoking container 190, which in turn will lead to air flow evenly penetrating and proceeding throughout the entire volume of the smoking material inside the smoking container 190. This more uniform air flow throughout the volume of the cannabis compacted in the smoking container 190 causes multiple portions of the cannabis load to maintain a slow burning process for an extended period of time—whereby addressing the nuisance problem of the burning process going out before completing the smoking session.

The elastic elongated stem insert 150 may be made to have a generally cylindrical shape sized to extend most of the way through the open end and along the interior wall 131 of the outer shell 130. In embodiments, the length of the elastic stem insert may be less than the length of the inner well inside the outer shell 130 by anywhere between 0.25 and 0.75 inches so as to create a smoke mixing cavity 170 sized to be at least 3 times larger in size than the serpentine smoke pathway 158, see FIG. 8. Mixing of the smoke drawn into the smoke mixing cavity 170 helps to make the smoking experience more uniform and avoid fluctuations of smoke temperature and concentration between inhalations of various strengths.

The end of the elastic stem insert closest to the bowl 160 may be equipped with one or a series of elastic O-rings 152 (see FIG. 11), optionally built into the body of the elongated stem insert 150 and sized to seal the interior wall 131 about and against the elastic stem insert 150 when the smoking pipe 100 is assembled.

The present invention provides an elongated smoke pathway extending from the bowl 160 towards the mouthpiece 102. In order to reduce the length of the pipe 100 to a compact size, the smoke pathway is arranged to have a serpentine shape. This may be achieved by providing one or several parallel convoluted serpentine grooves on the exterior of the elongated stem insert. Sealing the groove against the interior wall 131 forms the serpentine smoke pathway of the pipe 100. One exemplary way to arrange for this groove is now described in greater detail.

The elastic elongated stem insert 150 may contain a plurality of circular ribs 156 spaced along thereof and positioned generally orthogonal to the longitudinal axis of the smoking pipe of the invention—with radial grooves 155 formed inbetween respective pairs of adjacent circular ribs 156. While in some embodiments the space between adjacent circular ribs 156 may be the same for all successive circular ribs 156, in other embodiments, the spacing of the circular ribs 156 may be provided with a changing distance between the adjacent ribs.

In one example, circular ribs 156 located closer to the pipe bowl 160 may be positioned closer to each other as compared with circular ribs 156 located further towards the mouthpiece 102. Initially narrower smoke passages can allow for better removal of the smoking debris particles and tar droplets as the smoke enters the pipe 100 and travels through smaller grooves between the circular ribs 156 as explained in further detail below.

Yet, in further embodiments of the invention, the opposite may be the case, where the circular ribs 156 located closer to the bowl 160 may be positioned further away from each other as compared to the circular ribs 156 on the other end of the elongated stem insert 150. This arrangement may be used for better temperature control forcing a greater contact of the hottest smoke entering the handle of the pipe to be cooled off by heat dissipating metal outer shell 130.

Figure 15:
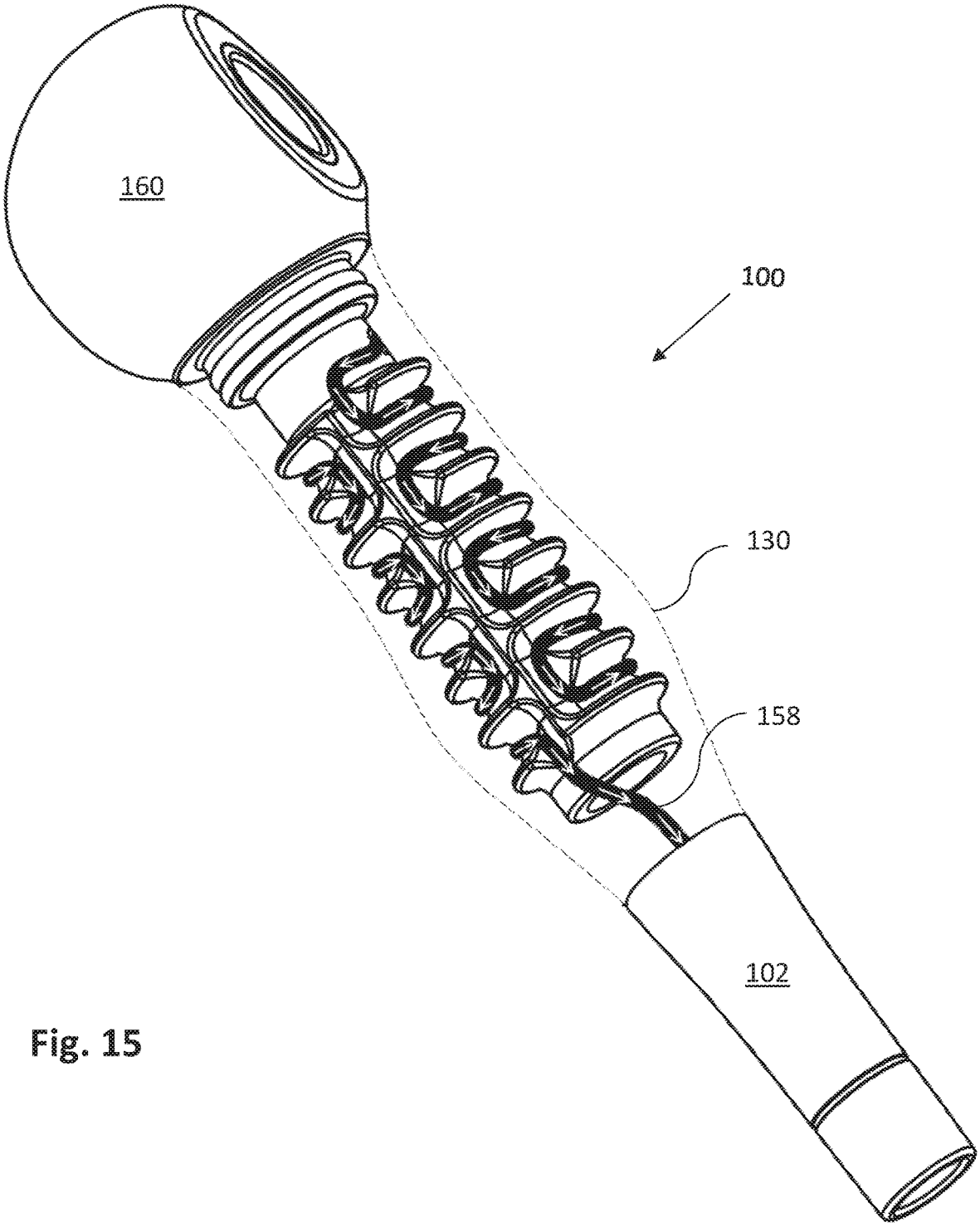
FIG. 15 shows a smoke pathway extending through the pipe of the invention.

Also formed along the elastic stem insert 150 is a side rib 154 traversing the distance between the first and the last circular rib 156. Each of the circular ribs 156 may be made to initiate and extend from the side rib 154 on one side 159 thereof and then to extend around the stem insert 150 in a circular pattern but not to reach the side rib 154 on the other side thereof—forming a gap 157 to allow the smoke to pass from one side of the circular rib 156 to the other. The gaps 157 between the circular ribs 156 and the side rib 154 may be located on alternating sides of the side rib 154 so as to form portions of said convoluted serpentine groove. Alternating the location of the gaps 157 on either side of the side rib 154 forms an extended convoluted serpentine smoke pathway groove 158 (see FIG. 15) with individual radial groves 155 extending in alternating directions around the stem insert 150. The serpentine groove in this case may be made for traversing the length of the pipe 100 from the bowl 160 to the mouthpiece 102 and featuring a plurality of radial grooves 155 with alternating entry and exit points along the side rib 154. The smoke pathway therefore features a plurality of segments with alternating direction of smoke propagation from one radial groove 155 to the next.

In embodiments, the total length of the smoke pathway (with the outer shell 130 in place to force the smoke to pass along the circular ribs 156 and not across them) may be from about 3 inches and higher, such as 3,5; 4; 4.5; 5; 5.5; 6; 6.5; 7; 7.5; 8; 9; 10; 11; 12; 13; 14; 15; 16; 17; 18; 19; 20 inches or more as the invention is not limited in this regard. As can be appreciated by those skilled in the art, the length of the smoke pathway may be selected to both satisfy the objectives of reduced temperature and enhanced smoke purification on one side and not to make the smoking pipe of the invention unnecessarily large on the other side.

In further embodiments contemplated by the present invention, more than one serpentine smoke pathway may be formed using respective parallel serpentine grooves formed on the exterior of the elongated stem insert 150 (not shown).

The elastic stem insert 150 and the pipe bowl 160 may be made from a single elastic material. It may be beneficial to use a thermo-insulating, biocompatible elastic material so as to assure a safety of the user. In embodiments, the selection of the suitable material may be made with consideration of a melting temperature thereof, which may be selected to be above the expected temperature of the burning cannabis—so as to avoid melting or another distortion or damage of the smoking pipe 100 during use.

Various individual colors and color mixtures may be added to the elastic material of the elongated stem insert 150. This may be done to allow several users to easily identify their own smoking pipe and avoid cross-contamination when a number of smoking pipes are used by a group of users at the same rime.

Finally, the elastic material should have sufficient extent of elasticity to allow an airtight fit of the stem insert 150 inside the outer shell 130—and yet allow for its removal and insert to be done without excessive effort. In embodiments, the elastic material for the stem insert 150 may be selected with shore A durometer ranging from about 40 to about 70, or in a range from medium soft to medium hard.

Polyethylene, polyurethane, polypropylene, natural rubber, silicone, or combinations thereof are all suitable examples of a material for the body of the stem insert 150. In addition to above listed considerations, the use of these materials may allow easy washing of the components of the smoking pipe 100 with conventional soap and water or even in a dishwasher to remove smoking debris and stains therefrom.

The elastic stem insert 150 and the pipe bowl 160 may be manufactured as a single unit using conventional polymer production techniques including molding, overmolding, insert molding, vacuum forming, casting, dip coating, etc. as the invention is not limited in this regard.

In embodiments, the outer diameter of the circular ribs 156 and optionally the side rib 154 may be made to match or exceed that of the inner diameter of the interior wall 131 of the outer shell 130 so as to assure compression of the stem insert 150 and an air-tight fit inside the outer shell 130. In embodiments, the size of the stem insert may exceed the size of the outer shell inner well by 0.025; 0.05; 0.075; 0.1; 0.125 inch or any suitable size difference inbetween as the invention is not limited in this regard.

In addition to providing a tight fit for securing of one component inside the other, oversizing the circular ribs 156 and the side rib 154 may help in using the stem insert 150 as a brush to remove smoking debris from the inside of the outer shell 130 after the smoking session is finished. To accomplish this, the stem insert 150 may be removed and reinserted once or multiple times inside the outer shell 130 whereby scrubbing the interior wall 131 thereof. Cleaning the stem insert 150 itself may also be less burdensome as the elastic surface may be easily manipulated to dislodge smoking debris that may adhere thereto.

Figure 13:
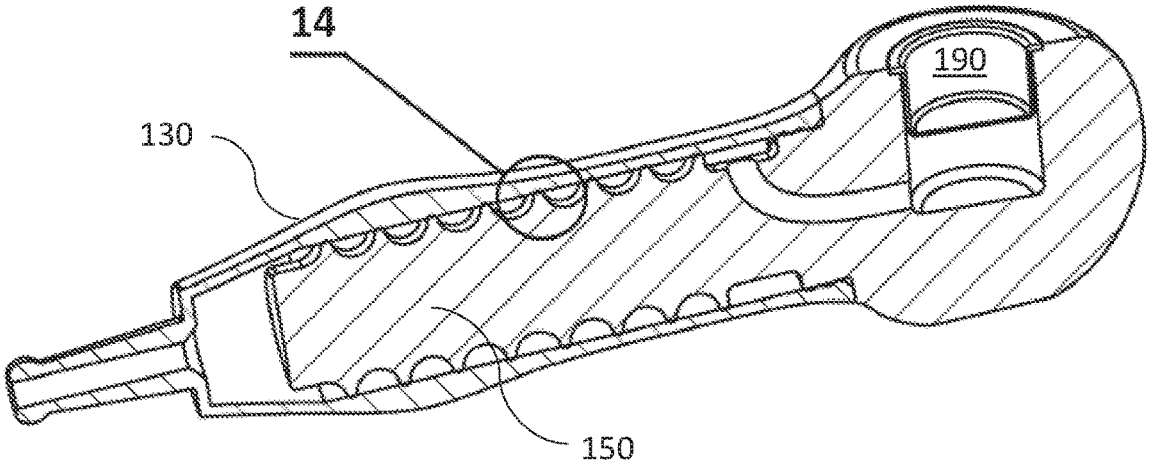
FIG. 13 is perspective cross-sectional view of the subassembly showing interaction between the elastic stem insert and the outer rigid shell, FIG. 14, panels A through F show an enlargement of the region indicated in FIG. 13.
Figure 14:
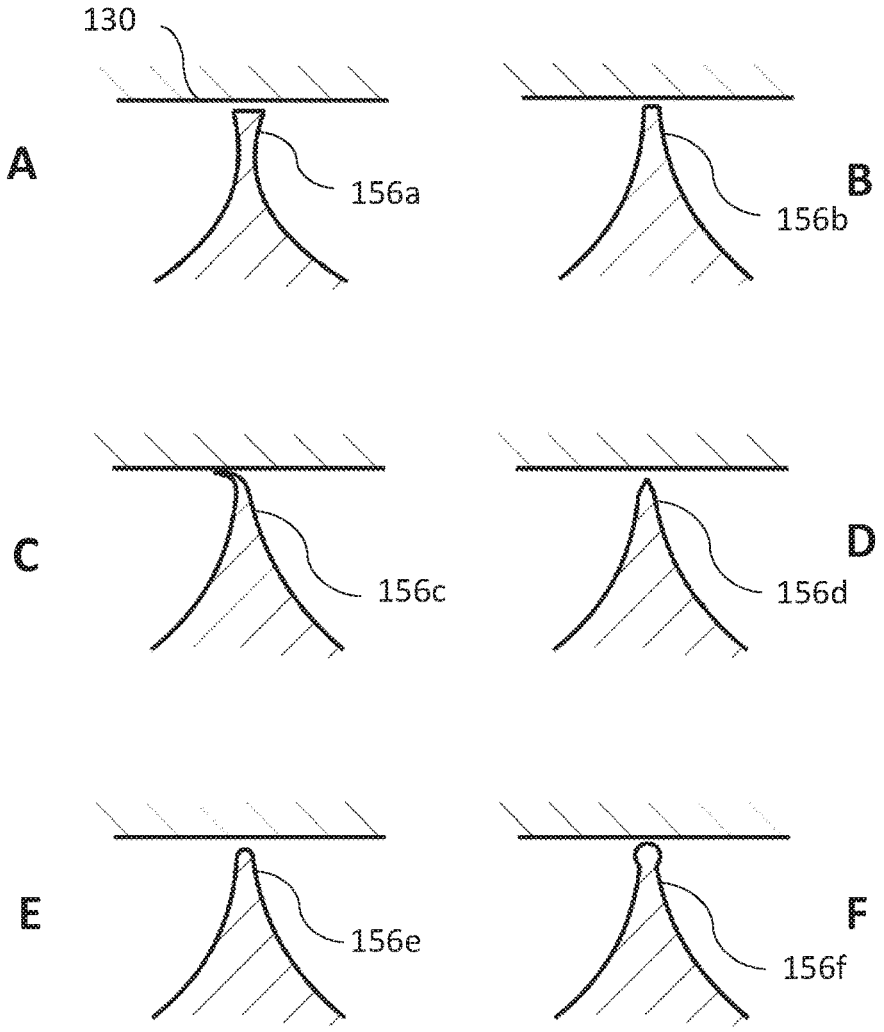

To further facilitate the cleaning of the smoking pipe of the present invention, the outer edge of the circular ribs 156 may have a shape advantageous for scrubbing the interior wall 131 as seen in FIG. 13 and a close-up in FIG. 14. Shown here in panels A through F are examples of various shapes of the outer edge **156*a* through 156*f* that may be advantageous to improve the fit of the stem insert 150 inside the outer shell 130 as well as cleaning of the interior wall 131. In particular, 156*a* shows an outer edge with an enlarged square tip, 156*b* shows a straight square tip, 156*c* shows a bent pointed tip, 156*d* is a straight pointed tip, 156*e* is a rounded tip, and 156*f*** is a bulbous tip.

To further facilitate the cleaning of the inner well of the outer shell 130 using the elongated stem insert 150 as a brush and the pipe bowl 160 as a brush handle, the tips of the circular ribs 156 may be made with semi-rigid or rigid inserts such as metal inserts matching the interior profile of the outer shell 130—so that reciprocal motion of the stem insert 150 inside the outer shell 130 produces active scrubbing of its interior wall 131. Such rigid inserts may be provided to be embedded into the elastic material of the stem insert 150 so as to not jeopardize the seal of the outer shell 130 about the stem insert 150 and leakage of smoke across the circular ribs 156 while in use.

Figure 16:
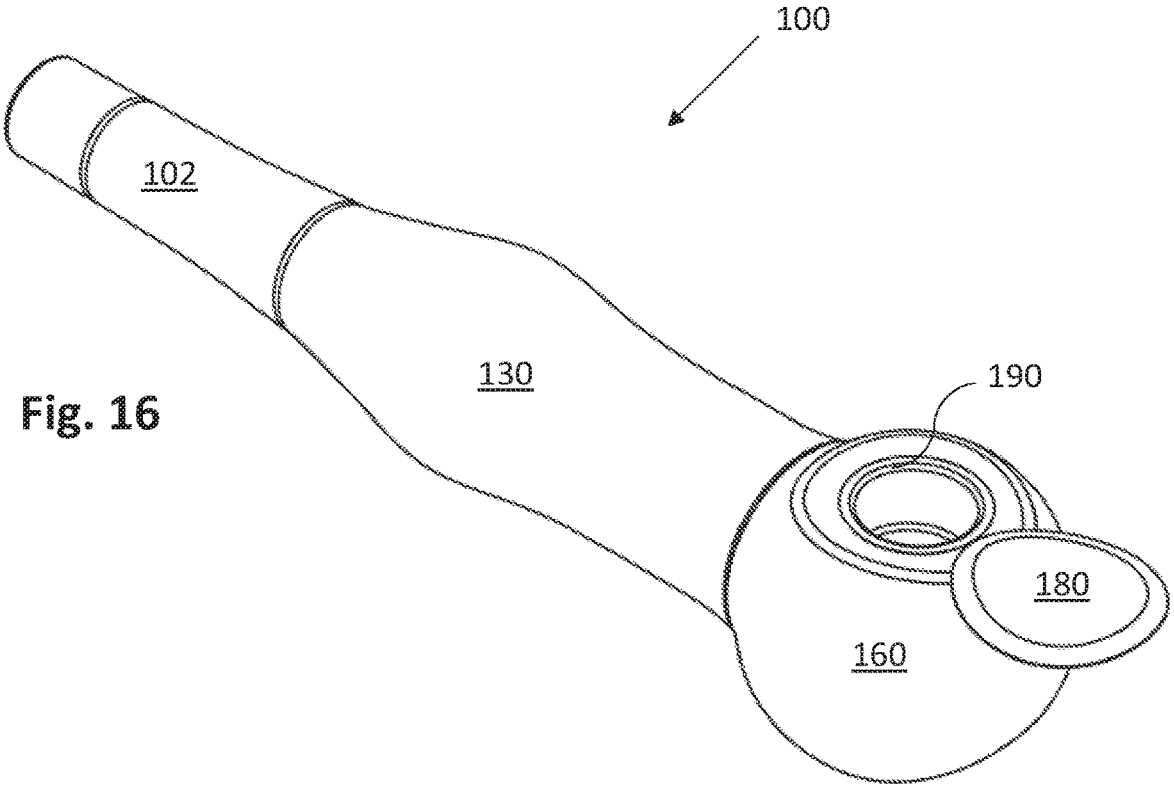
FIG. 16 shows a perspective view of the pipe with the open bowl cover.
Figure 17:
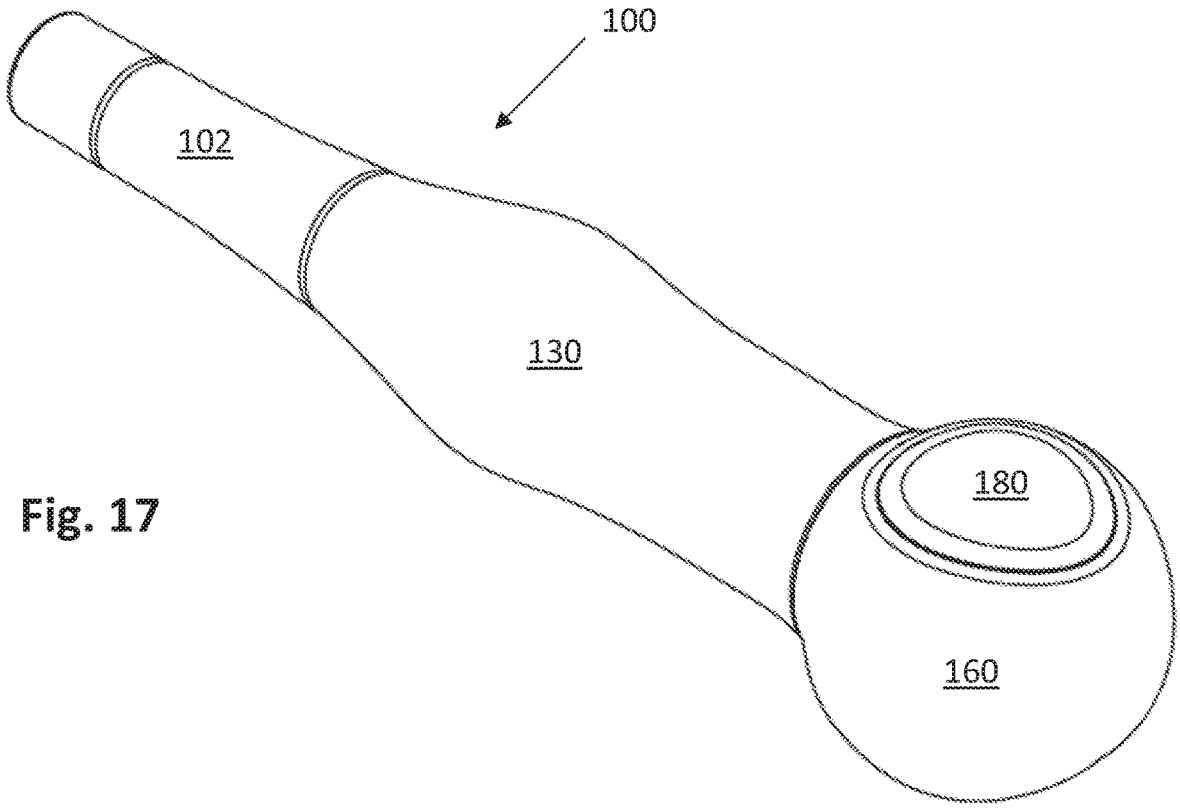
FIG. 17 shows the same but with the bowl cover n a closed position.
Figure 18:
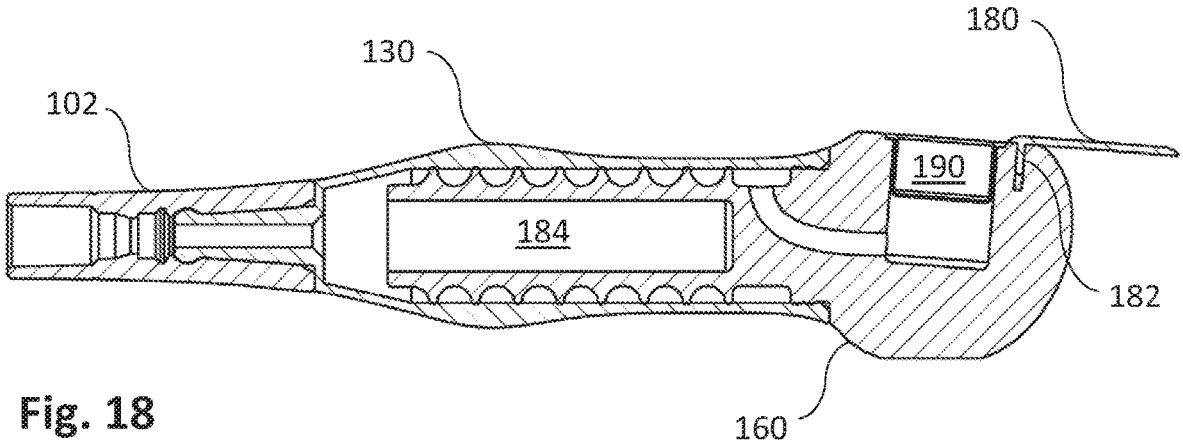
FIG. 18 shows a cross-sectional side view of the same as in FIG. 16.
Figure 19:
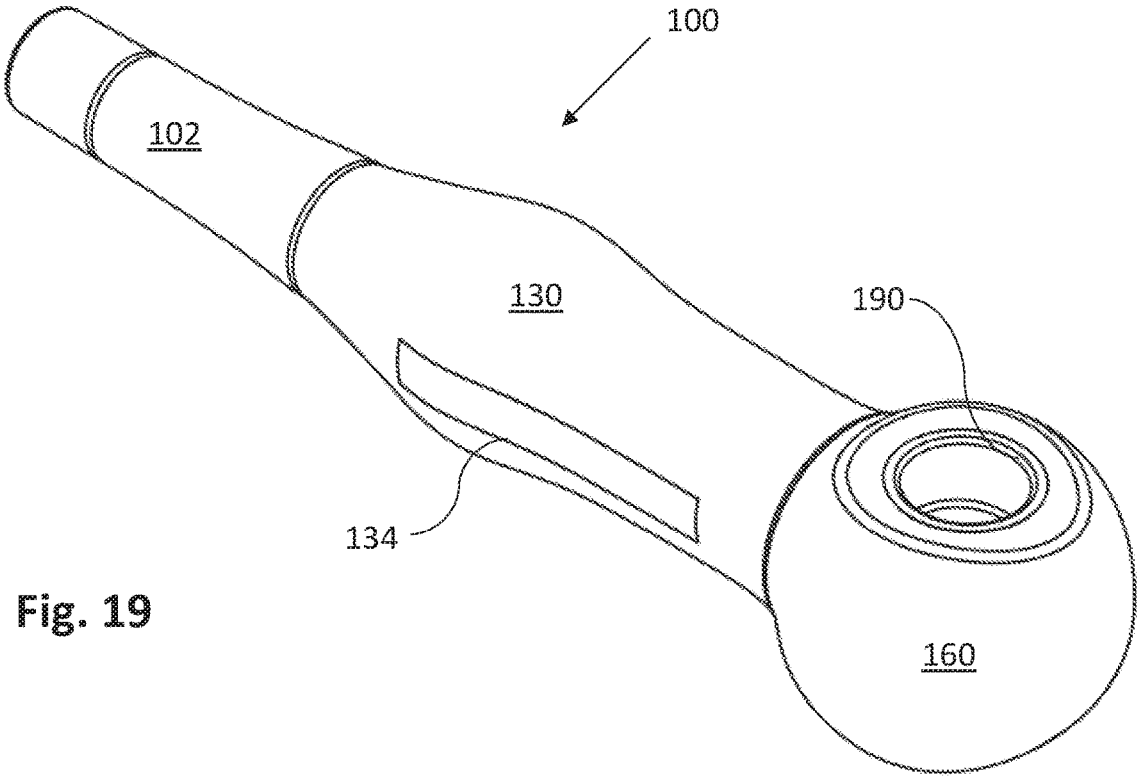
FIG. 19 shows a perspective view of the smoking pipe of the invention equipped with a side window.
Figure 20:
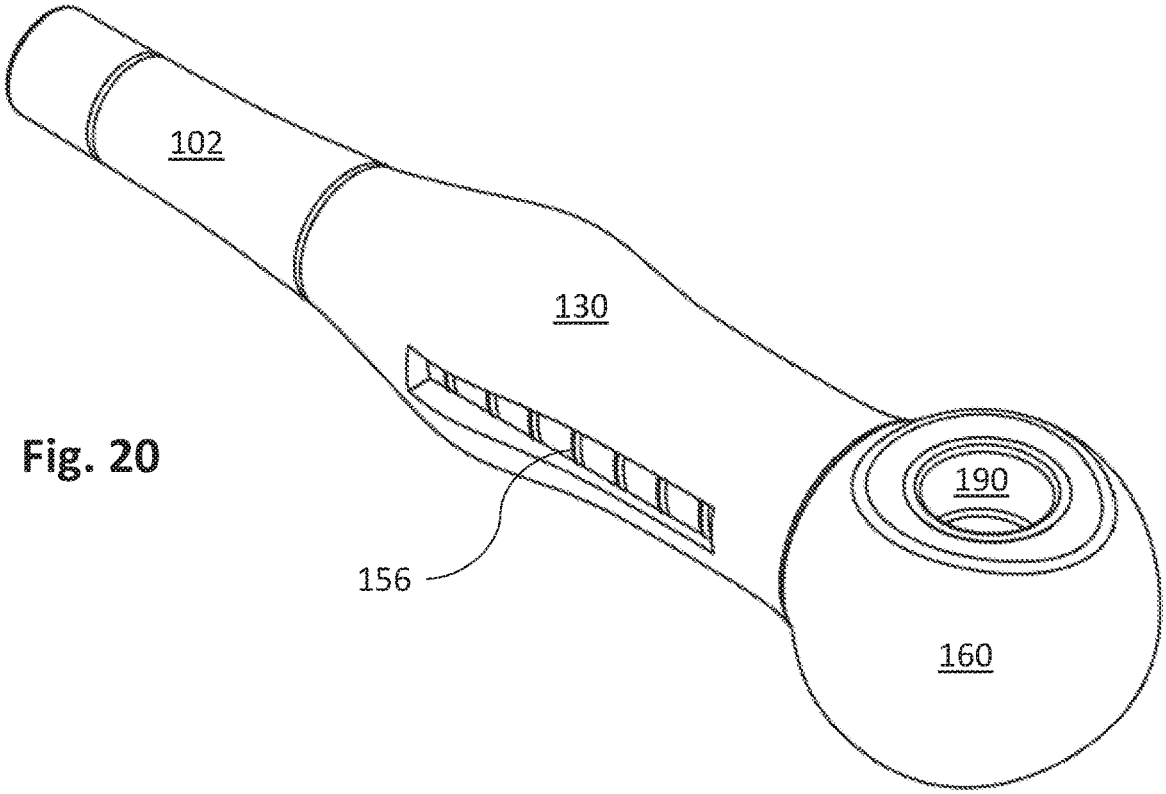
FIG. 20 shows the same but with the side window removed.
Figure 21:
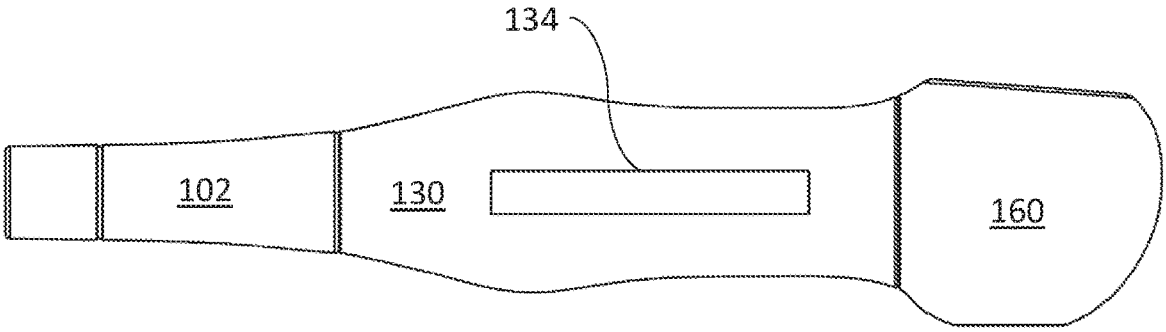
FIG. 21 shows the side view of the smoking pipe of FIG. 19.
Figure 22:
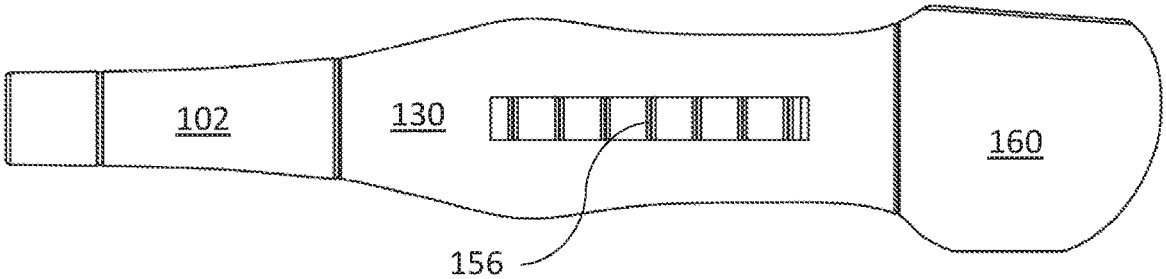
FIG. 22 shows the side view of the same but with the side window removed.
Figure 23:
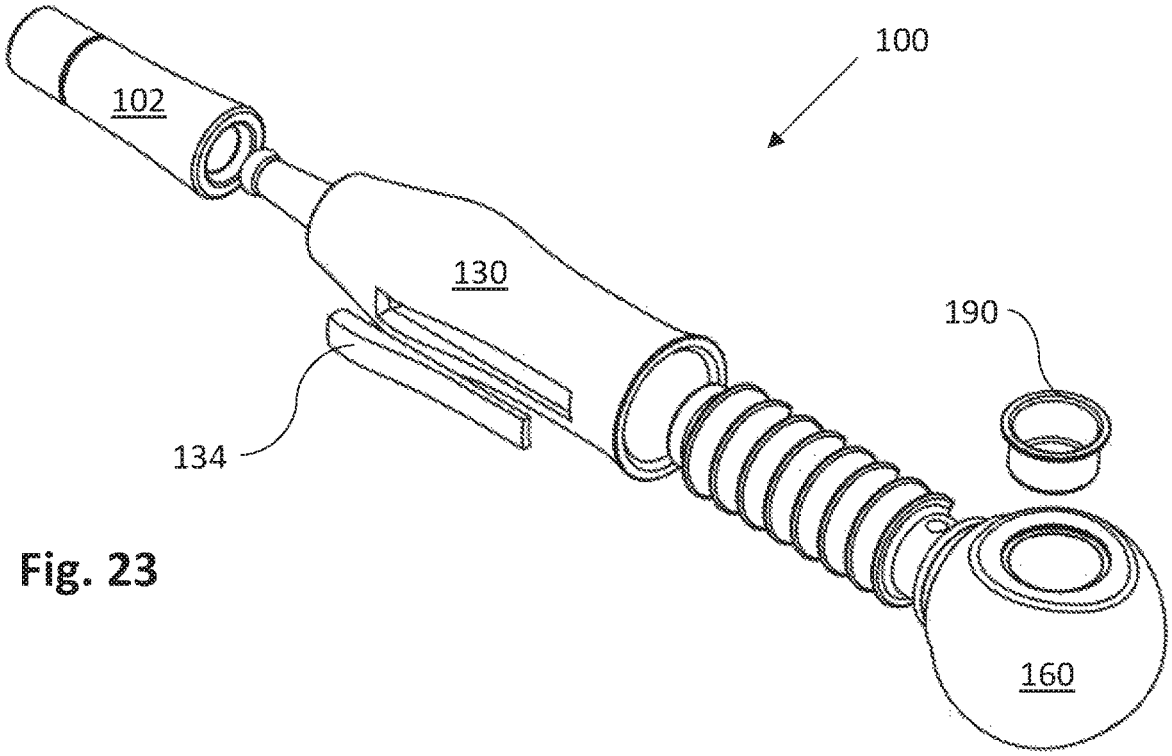
FIG. 23 shows an exploded perspective view of all components of the smoking pipe with the side window.

FIGS. 16,17, and 18 show a further variation of the smoking pipe 100 of the invention. One advantageous feature of this embodiment is a removable cover 180 which may be used to enclose the cannabis container having a load of cannabis placed therein in the pipe bowl 160 so as to prevent propagation of cannabis aroma away from the pipe 100. FIG. 17 shows the cover 180 in a closed position and FIG. 16 shows the same in the open position. Closed cover may be useful for transporting the smoking pipe 100 loaded with the smoking material and ready for use. The details of this design are illustrated in FIG. 18, showing the cover 180 retained at the pipe bowl 160 by a rotating pin 182, which allows the cover 180 to swing away from the opening of the bowl well 164.

A further improvement is a stem insert void 184 made inside the body of the stem insert 150. This cavity may be used to store a container with cannabis or a stack of sealed cannabis containers 190 so as to allow the user to use the pipe 100 as both the smoking implement and a storage item for retaining smoking material. The void 184 may also be used to position a freezable insert sized appropriately to fit snugly inside thereof. Positioning such insert which was previously frozen in a refrigerator may be used to further cool down the smoke passing through a serpentine smoke pathway in close vicinity to the freezable insert (not shown in the drawings).

Finally, FIGS. 19 through 23 illustrate a further yet improvement for the smoking pipe of the present invention—an observation window 134 positioned along the outer shell 130 and designed to allow the user to observe the extent of deposit of the smoking debris and tar droplets on the interior wall 131 and inside the grooves 155 if the stem insert 150. The location of the observation window 134 may be selected to be closer to the pipe bowl 160 side of the pipe 100 as it is expected to attract more smoking debris upon smoke entrance therein as compared with the mouthpiece end of the smoking pipe 100. The observation window 134 may be made using any suitable transparent material such as glass or heat-resistant transparent polymer, for example polycarbonate or polyethylene, which may be glued, sealingly snapped in place or positioned using other air-tight assembly techniques.

The presence of the observation window 134 may help avoid unnecessary effort of cleaning of an otherwise clean outer shell—while at the same time serving as a visual indicator to the user to prompt a necessary cleaning operation of the pipe components.

As can also be appreciated by those skilled in the art, the term "pipe" is used herein in a broad sense of the work to define a plurality of similar smoking implements. For example, a pipe bowl may be easily replaced with a cigarette holder or another type of a connector to or a holder for a burning smoking material, as the invention is not limited in this regard.

It is contemplated that any embodiment discussed in this specification can be implemented with respect to any method of the invention, and vice versa. It will be also understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference. Incorporation by reference is limited such that no subject matter is incorporated that is contrary to the explicit disclosure herein, no claims included in the documents are incorporated by reference herein, and any definitions provided in the documents are not incorporated by reference herein unless expressly included herein.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps. In embodiments of any of the compositions and methods provided herein, "comprising" may be replaced with "consisting essentially of" or "consisting of". As used herein, the phrase "consisting essentially of" requires the specified integer(s) or steps as well as those that do not materially affect the character or function of the claimed invention. As used herein, the term "consisting" is used to indicate the presence of the recited integer (e.g., a feature, an element, a characteristic, a property, a method/process step or a limitation) or group of integers (e.g., feature(s), element(s), characteristic(s), propertie(s), method/process steps or limitation(s)) only.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skilled in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12, 15, 20 or 25%.

All of the devices and/or methods disclosed and claimed herein can be made and executed without undue experimentation in light of the present disclosure. While the devices and methods of this invention have been described in terms of preferred embodiments, it will be apparent to those of skill in the art that variations may be applied to the devices and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. A compact smoking pipe comprising:

a rigid outer shell with an inner elongated well having an open end on one side thereof, an elastic elongated stem insert configured for insertion into said outer shell through said open end and for removably retaining inside thereof, said elastic stem insert having a convoluted serpentine groove extending from one end of said stem insert to an opposite end thereof, a pipe bowl made together with said elastic stem insert as a single unit, said bowl protruding from said outer shell upon assembly of said smoking pipe, said bowl having a bowl well configured for placement of a smoking material therein, said bowl well is operably connected via a passage to said serpentine groove of said elastic stem insert, wherein when said smoking pipe is assembled together, said outer shell and said elastic stem insert defining a convoluted serpentine smoke pathway formed between said serpentine grove and an interior wall of said inner elongated well of said outer shell, and wherein said elastic elongated stem insert is sized to be larger than said inner elongated well, whereby during assembly of said smoking pipe said elastic elongated stem insert is compressed and elastically deformed to remain inside said outer shell.

2. The compact smoking pipe as in claim 1, wherein said rigid outer shell is made from a thermo-conductive material.

3. The compact smoking pipe as in claim 1, wherein said outer shell is made from metal.

4. The compact smoking pipe as in claim 1 further comprising a replaceable mouthpiece configured to be removably attached to said rigid outer shell at a location opposite said open end of said inner elongated well.

5. The compact smoking pipe as in claim 1, wherein said elastic elongated stem insert comprises a side rib extending from said one end to the opposite end thereof and a plurality of circular ribs, together forming said convoluted serpentine groove.

6. The compact smoking pipe as in claim 5, wherein said serpentine grove is at least 3 inches long.

7. The compact smoking pipe as in claim 5, wherein each of said circular ribs extends from one side of said side rib towards the other side thereof, each of said circular ribs forms a gap with said side rib on either side thereof.

8. The compact smoking pipe as in claim 7, wherein said gaps between said circular ribs and said side rib are located on alternating sides of said side rib so as to form portions of said convoluted serpentine groove extending in alternating directions around said stem insert.

9. The compact smoking pipe as in claim 5, wherein said circular ribs are spaced evenly along said stem insert.

10. The compact smoking pipe as in claim 5, wherein said circular ribs are positioned closer together on one side of said stem insert as compared with the other side of said stem insert.

11. The compact smoking pipe as in claim 5, wherein said circular ribs are equipped with the tips configured for cleaning said inner well of said outer shell from smoking debris upon removing of said stem insert therefrom.

12. The compact smoking pipe as in claim 11, wherein said tips are selected from a group of tips consisting of: an enlarged square tip, a straight square tip, a bent pointed tip, a straight pointed tip, a rounded tip, and a bulbous tip.

13. The compact smoking pipe as in claim 1, wherein said outer shell further comprises an observation window configured to allow visual monitoring of the extent of smoking debris deposit inside thereof.

14. The compact smoking pipe as in claim 13, wherein said observation window is located adjacent said open end of said outer shell.

15. The compact smoking pipe as in claim 1, wherein said elastic stem insert defining an internal void configured to accept a freezable insert therein or serve for storage purposes.

16. The compact smoking pipe as in claim 1, wherein a smoke mixing cavity is formed between one end of said elastic elongated stem insert and said rigid outer shell at the end of said serpentine smoke pathway extending from said pipe bowl, whereby said smoke mixing cavity is configured to facilitate making smoking experience more uniform and avoid fluctuations of smoke temperature and concentration.

17. The compact smoking pipe as in claim 1, wherein said elongated elastic stem insert further comprises an O-ring formed therein adjacent said pipe bowl and sized to seal said inner well about said stem insert upon assembly of said smoking pipe.

18. The compact smoking pipe as in claim 1, wherein said pipe bowl further comprises a cover configured to removably close off said bowl well to prevent propagation of smoking material aroma away from said smoking pipe inbetween smoking sessions.

19. The compact smoking pipe as in claim 1 further comprising a container for loading a smoking material therein, said container having a screen to support the smoking material therein while allowing air and smoke to pass therethrough, said container is sized to fit inside said bowl well forming a smoke chamber below thereof and in series with said passage, whereby said smoking chamber configured to evenly distribute air and smoke flow throughout said container during use.

20. The compact pipe as in claim 19, wherein said smoke chamber is sized to be even or greater than said passage between the bowl well and said serpentine groove.

* * * * *